US010183841B2

(12) United States Patent
Dudde et al.

(10) Patent No.: US 10,183,841 B2
(45) Date of Patent: Jan. 22, 2019

(54) MULTI-WEDGE END TERMINATION FOR AN ELEVATOR SYSTEM

(71) Applicants: ThyssenKrupp Elevator AG, Essen (DE); ThyssenKrupp AG, Essen (DE)

(72) Inventors: Frank Dudde, Collierville, TN (US); Peter Feldhusen, Collierville, TN (US)

(73) Assignees: THYSSENKRUP ELEVATOR AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/376,140

(22) Filed: Dec. 12, 2016

(65) Prior Publication Data

US 2018/0162696 A1 Jun. 14, 2018

(51) Int. Cl.
*B66B 7/08* (2006.01)
*B66B 9/00* (2006.01)

(52) U.S. Cl.
CPC ..... *B66B 7/085* (2013.01); *B66B 9/00* (2013.01)

(58) Field of Classification Search
CPC ..... B66B 7/062; B66B 7/085; B66B 9/00
See application file for complete search history.

(56) References Cited

U.S. PATENT DOCUMENTS 5,539,961 A * 7/1996 DeFrance ..... H02G 7/056 24/136 R
6,256,841 B1 7/2001 Ericson et al.
6,357,085 B2 3/2002 Ericson et al.
6,820,726 B1 11/2004 Ericson et al.
7,875,056 B2 * 1/2011 Jervis ..... A61B 17/0487 24/115 M
7,891,060 B2 * 2/2011 Ross ..... E21B 19/12 24/136 R
8,001,660 B2 * 8/2011 Cai ..... F16G 11/14 24/115 H
8,375,527 B1 * 2/2013 Crow ..... F16G 11/046 24/136 L
8,505,173 B2 * 8/2013 Pitts ..... B66B 7/085 24/136 R
9,790,055 B2 * 10/2017 Kere ..... B66B 7/085
2004/0129506 A1 * 7/2004 Ericson ..... B66B 7/085 187/411
2010/0178150 A1 * 7/2010 Fargo ..... B66B 7/085 414/800
2014/0182975 A1 * 7/2014 Ikonen ..... B66B 5/0031 187/251

(Continued)

FOREIGN PATENT DOCUMENTS

EP 2354073 A1 8/2011
KR 1020090066048 A 6/2009

(Continued)

*Primary Examiner* — Jason W San
(74) *Attorney, Agent, or Firm* — The Webb Law Firm

(57) ABSTRACT

An end termination for an elevator system including at least two opposing outer plates connected to one another, at least two opposing guiding elements held between the outer plates, and at least two opposing wedges extending between the guiding elements and configured to clamp an elevator belt therebetween. Upon application of a belt pull force to the elevator belt, the wedges are deformed towards one another to increase a clamping force on the elevator belt.

18 Claims, 10 Drawing Sheets

(56) References Cited

U.S. PATENT DOCUMENTS

| | | | | |
|---|---|---|---|---|
| 2015/0151948 | A1* | 6/2015 | Pelto-Huikko | B66B 9/00 187/254 |
| 2016/0152445 | A1* | 6/2016 | Lehtinen | B66B 7/085 187/393 |
| 2016/0185572 | A1* | 6/2016 | Lehtinen | B66B 7/085 187/411 |
| 2016/0355378 | A1* | 12/2016 | Lehtinen | B66B 7/085 |
| 2017/0036891 | A1* | 2/2017 | Lehtinen | B66B 7/085 |

FOREIGN PATENT DOCUMENTS

| | | | |
|---|---|---|---|
| WO | 0151400 | A1 | 7/2001 |
| WO | 201000330 | A1 | 1/2010 |
| WO | 2016100775 | A1 | 6/2016 |

* cited by examiner

MULTI-WEDGE END TERMINATION FOR AN ELEVATOR SYSTEM

BACKGROUND OF THE INVENTION

Field of the Invention

This disclosure relates generally to an end termination for use with an elevator system and, more particularly, to a multi-wedge end termination for use with an elevator system.

Description of Related Art

A conventional elevator system includes a car, at least one counterweight, two or more ropes interconnecting the car and counterweights, a motor arrangement for moving the car and counterweight, and end terminations for each end of the ropes at connection points with the building, car, counterweight, and/or a frame of the motor arrangement. The ropes are traditionally formed of laid or twisted steel wire that are easily and reliably terminated by compression end terminations. Currently, however, the industry has moved towards using flat ropes or belts that have small cross-section cords and polymeric jackets. Therefore, there is a current need for an end termination for use in an elevator system using flat ropes or belts that optimizes terminations and load transfers of the flexible flat ropes or belts currently used in the industry.

End terminations are important components in elevator systems since the end terminations transfer the load between the belt ends and structural elements or moving components, such as elevator cars and/or counterweights. A malfunction of an end termination can cause serious damage on an elevator and poses a serious safety risk to passengers. In the event the belt slips or breaks in the end termination, the belt, which is connected to the termination, is loose and cannot transfer the load between the car and the counterweight. In order to prevent such an event, the load transfer between the belt end termination should be as smooth as possible. A wedge-type end termination may be used, in which the belt is arranged around a single wedge. The wedge and the belt together are held in a wedge housing. By using this wedge-type end termination arrangement, however, it is often difficult to achieve a smooth and defined load transfer in each operating situation. It is difficult to accurately achieve a desired load transfer since the load transfer with the single wedge-type end termination arrangement is often variable and unpredictable.

SUMMARY OF THE INVENTION

In view of the foregoing, a need exists for an end termination that provides a smooth load transfer between the car and the counterweight. A further need exists for an end termination that is easily adjustable and provides an easily adjustable load transfer curve that fits to the currently used belt types for elevator systems. A further need exists for an end termination that provides a defined load transfer curve by providing a belt clamp force that is adjustable over a clamped belt length.

In accordance with one aspect, an end termination for an elevator system may include at least two opposing outer plates connected to one another, at least two opposing guiding elements held between the outer plates, and at least two opposing wedges extending between the guiding elements and configured to clamp an elevator belt therebetween. Upon application of a belt pull force to the elevator belt, the wedges may be deformed towards one another to increase a clamping force on the elevator belt.

Each outer plate may define a cavity and include two opposing inner side edges that are inclined relative to a longitudinal axis of the end termination. The guiding elements may each include at least two inclined extension members each in contact with one of the inclined inner side edges of one of the outer plates. Upon application of the belt pull force to the elevator belt, the guiding elements may be moved axially in the cavities of the outer plates. The movement of the guiding elements may impart a force on opposing ends of the wedges to deform the wedges toward one another adjusting a distribution of the clamping force on the elevator belt based on a belt pull force, allowing reversible slippage of the elevator belt within the end termination. Each wedge may include a thickness on a first side thereof that is greater than a thickness on a second side thereof. The wedges may be positioned on opposing sides of the elevator belt such that the first side of a first wedge is positioned opposite the second side of a second wedge. Each wedge may include a top member and a bottom member opposing the top member, the top member and the bottom member defining an air gap therebetween. A first plurality of wedges and a second plurality of wedges may be provided. The first plurality of wedges and the second plurality of wedges may be positioned on opposing sides of the elevator belt and distributed longitudinally along the elevator belt. Each guiding element may define a slot to receive one end of each wedge.

In another aspect according to the disclosure, an elevator system may include at least one elevator car hoisted and lowered by an elevator belt, and at least one end termination operatively connected to the elevator belt and the elevator car. The end termination may include at least two opposing outer plates connected to one another, at least two opposing guiding elements held between the outer plates, and at least two opposing wedges extending between the guiding elements and configured to clamp the elevator belt therebetween. Upon application of a belt pulling force to the elevator belt, the wedges may be deformed towards one another to increase a clamping force on the elevator belt.

Each outer plate may define a cavity and include two opposing inner side edges that are inclined relative to a longitudinal axis of the end termination. The guiding elements may each include at least two inclined extension members each in contact with one of the inclined inner side edges of one of the outer plates. Upon application of the belt pull force to the elevator belt, the guiding elements may be moved axially in the cavities of the outer plates. The movement of the guiding elements may impart a force on opposing ends of the wedges to deform the wedges toward one another adjusting a distribution of the clamping force on the elevator belt based on a belt pull force, allowing reversible slippage of the elevator belt within the end termination. Each wedge may include a thickness on a first side thereof that is greater than a thickness on a second side thereof. The wedges may be positioned on opposing sides of the elevator belt such that the first side of a first wedge is positioned opposite the second side of a second wedge. Each wedge may include a top member and a bottom member opposing the top member, the top member and the bottom member defining an air gap therebetween. A first plurality of wedges and a second plurality of wedges may be provided. The first plurality of wedges and the second plurality of wedges may be positioned on opposing sides of the elevator belt and distributed longitudinally along the elevator belt. Each guiding element may define a slot to receive one end of each wedge.

Further aspects will now be described in the following numbered clauses.

Clause 1: An end termination for an elevator system, comprising: at least two opposing outer plates connected to one another; at least two opposing guiding elements held between the outer plates; and at least two opposing wedges extending between the guiding elements and configured to clamp an elevator belt therebetween, wherein, upon application of a belt pull force to the elevator belt, the wedges are deformed towards one another to increase a clamping force on the elevator belt.

Clause 2: The end termination as claimed in Clause 1, wherein each outer plate defines a cavity and includes two opposing inner side edges that are inclined relative to a longitudinal axis of the end termination.

Clause 3: The end termination as claimed in Clause 1 or Clause 2, wherein the guiding elements each include at least two inclined extension members each in contact with one of the inclined inner side edges of one of the outer plates.

Clause 4: The end termination as claimed in Clause 2, wherein, upon application of the belt pull force to the elevator belt, the guiding elements are moved axially in the cavities of the outer plates.

Clause 5: The end termination as claimed in Clause 4, wherein the movement of the guiding elements imparts a force on opposing ends of the wedges to deform the wedges toward one another adjusting a distribution of the clamping force on the elevator belt based on a belt pull force, allowing reversible slippage of the elevator belt within the end termination.

Clause 6: The end termination as claimed in any of Clauses 1-5, wherein each wedge includes a thickness on a first side thereof that is greater than a thickness on a second side thereof.

Clause 7: The end termination as claimed in Clause 6, wherein the wedges are positioned on opposing sides of the elevator belt such that the first side of a first wedge is positioned opposite the second side of a second wedge.

Clause 8: The end termination as claimed in any of Clauses 1-7, wherein each wedge includes a top member and a bottom member opposing the top member, the top member and the bottom member defining an air gap therebetween.

Clause 9: The end termination as claimed in any of Clauses 1-8, further comprising a first plurality of wedges and a second plurality of wedges, and wherein the first plurality of wedges and the second plurality of wedges are positioned on opposing sides of the elevator belt and distributed longitudinally along the elevator belt.

Clause 10: The end termination as claimed in any of Clauses 1-9, wherein each guiding element defines a slot to receive one end of each wedge.

Clause 11: An elevator system, comprising: at least one elevator car hoisted and lowered by an elevator belt; and at least one end termination operatively connected to the elevator belt and the elevator car, the end termination comprising: at least two opposing outer plates connected to one another; at least two opposing guiding elements held between the outer plates; and at least two opposing wedges extending between the guiding elements and configured to clamp the elevator belt therebetween, wherein, upon application of a belt pulling force to the elevator belt, the wedges are deformed towards one another to increase a clamping force on the elevator belt.

Clause 12: The end termination as claimed in Clause 11, wherein each outer plate defines a cavity and includes two opposing inclined inner edges.

Clause 13: The end termination as claimed in Clause 12, wherein the guiding members each include at least two inclined extension members each in contact with one of the inclined inner edges of one of the outer plates.

Clause 14: The end termination as claimed in Clause 12, wherein, upon application of the belt pull force to the elevator belt, the guiding elements are moved axially in the cavities of the outer plates.

Clause 15: The end termination as claimed in Clause 14, wherein the movement of the guiding elements imparts a force on opposing ends of the wedges to deform the wedges toward one another adjusting a distribution of the clamping force on the elevator belt based on a belt pull force, allowing reversible slippage of the elevator belt within the end termination.

Clause 16: The end termination as claimed in any of Clauses 11-15, wherein each wedge includes a thickness on a first side thereof that is greater than a thickness on a second side thereof.

Clause 17: The end termination as claimed in Clause 16, wherein the wedges are positioned on opposing sides of the elevator belt such that the first side of a first wedge is positioned opposite the second side of a second wedge.

Clause 18: The end termination as claimed in any of Clauses 11-17, wherein each wedge includes a top member and a bottom member opposing the top member, the top member and the bottom member defining an air gap therebetween.

Clause 19: The end termination as claimed in any of Clauses 11-18, further comprising a first plurality of wedges and a second plurality of wedges, and wherein the first plurality of wedges and the second plurality of wedges are positioned on opposing sides of the elevator belt and distributed longitudinally along the elevator belt.

Clause 20: The end termination as claimed in any of Clauses 11-19, wherein each guiding element defines a slot to receive one end of each wedge.

Further details and advantages will be understood from the following detailed description read in conjunction with the accompanying drawings.

DESCRIPTION OF THE DISCLOSURE

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, an end termination for an elevator system and, in particular, to a multi-wedge end termination for an elevator system. Certain preferred and non-limiting aspects of the components of the end termination are illustrated in FIGS. 1-11.

Figure 1:
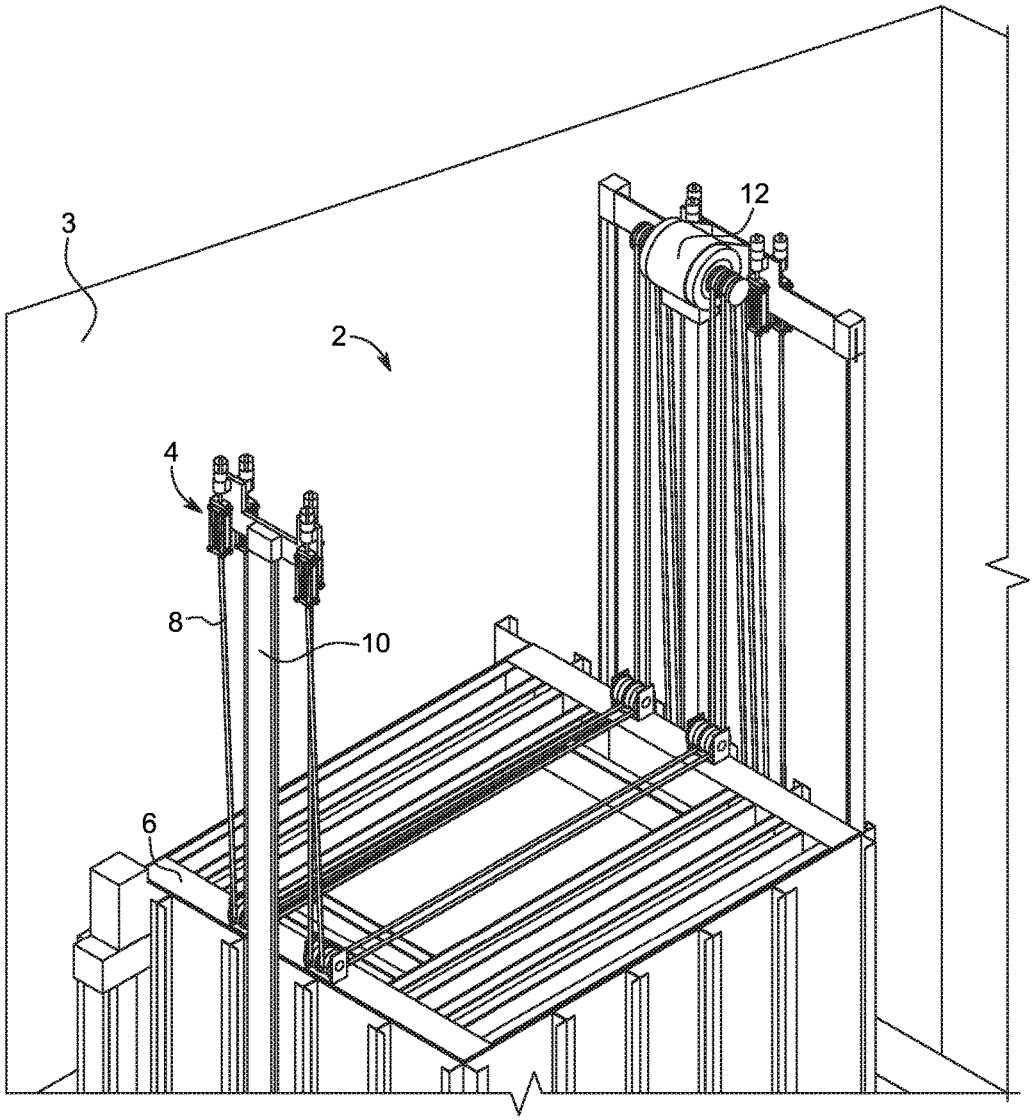
FIG. 1 is a perspective view of an elevator system including at least one end termination according to an aspect of the present disclosure.

With reference to FIG. 1, an elevator system 2 utilizing at least one end termination 4 is shown. The elevator system 2 may include an elevator car 6 and counterweight movable within an elevator shaft 3 using a plurality of belts 8 that hoist and/or lower the elevator car 6. In one aspect, the elevator system 2 includes four belts 8 configured to move the elevator car 6 and counterweight within the elevator shaft. Each end of each belt 8 may be held in a separate end termination 4 held on another component of the elevator system 2. The other component of the elevator system 2 may be one or more of the elevator car 6, a support beam or structure 10 of the elevator car 6 and/or counterweight, a portion of the elevator shaft, or the counterweight. In one aspect, the elevator system 2 utilizes eight separate end terminations 4 to control the load transfer between the elevator car 6 and a counterweight. A motor arrangement 12 may be configured to drive the belts 8 to lift and lower the elevator car 6.

With reference to FIGS. 2-10, the end termination 4 is shown and described. In one aspect, the end termination 4 may be a multi-wedge end termination 4 with an adjustable load transfer function. Operation and use of the end termination 4 is described in greater detail below. The end termination 4 may include a front outer wedge plate 14*a* and a rear outer wedge plate 14*b* (also referred to as outer plates) held together with a plurality of fasteners 16 to house the inner components of the end termination 4. In one aspect, the outer wedge plates 14*a*, 14*b* are removably fastened to one another by the fasteners 16 to permit an operator to disassemble the outer wedge plates 14*a*, 14*b* to replace any inner components of the end termination 4. The fasteners 16 may be bolts, screws, or any other similar type of mechanical fastener that may be used to hold together the outer wedge plates 14*a*, 14*b*. It is also contemplated that the outer wedge plates 14*a*, 14*b* may be welded together or formed as a monolithic structure. In one aspect, the outer wedge plates 14*a*, 14*b* may be generally rectangular in shape and may define a cavity 18*a*, 18*b*. The inner side surfaces or edges of each cavity 18*a*, 18*b* may be slightly inclined relative to a longitudinal axis of the end termination 4.

Figure 2:
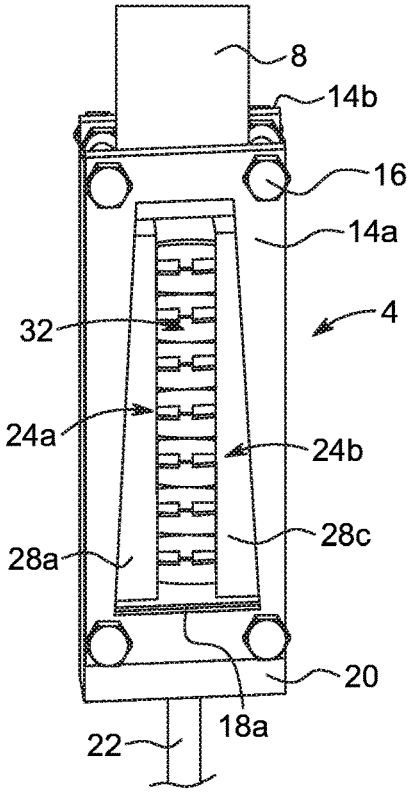
FIG. 2 is a front view of an end termination used in the elevator system of FIG. 1.
Figure 3:
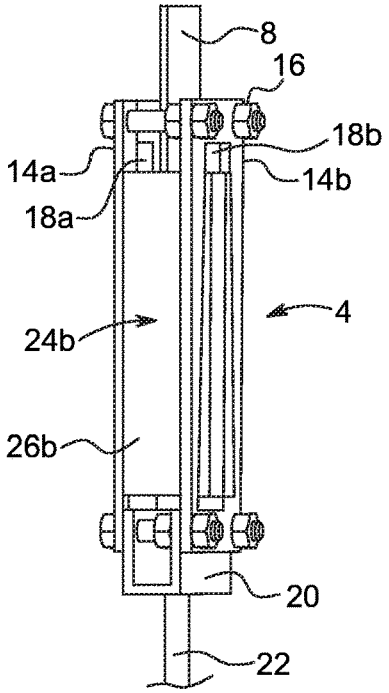
FIG. 3 is a side perspective view of the end termination of FIG. 2.
Figure 4:
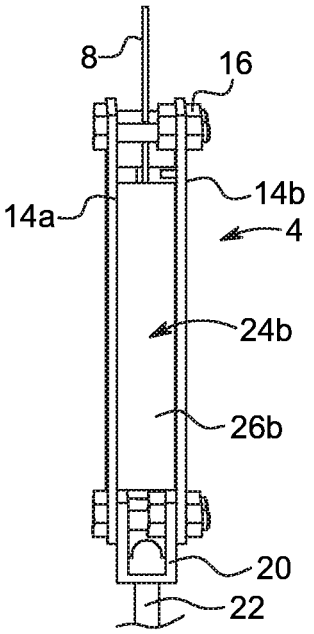
FIG. 4 is a side view of the end termination of FIG. 2.

As shown in FIGS. 2 and 3, a bottom end of each outer wedge plate 14*a*, 14*b* may be connected to a rod holder 20. The rod holder 20 may include a rod 22 that extends from another component of the elevator system 2. In one aspect, the other component of the elevator system 2 is the support structure 10 of the elevator car 6. The rod holder 20 may include an opening to guide a loose belt end with a variable length through the opening of the end termination 4. The fasteners 16 may extend through the bottom end of the outer wedge plates 14*a*, 14*b* and through the rod holder 20 to connect the outer wedge plates 14*a*, 14*b* to the rod holder 20.

As shown in FIGS. 2-6, the end termination 4 may also include at least two guiding elements 24*a*, 24*b* configured to move relative to the outer wedge plates 14*a*, 14*b*. Each guiding element 24*a*, 24*b* may include a base member 26*a*, 26*b* and at least two inclined extension members 28*a*, 28*b*, 28*c*, 28*d*. When the end termination 4 is assembled, the guiding elements 24*a*, 24*b* may be held between the outer wedge plates 14*a*, 14*b* such that the extension members 28*a*-28*d* extend into the cavities 18*a*, 18*b* defined by the outer wedge plates 14*a*, 14*b*. In this arrangement, the inclined surfaces of the extension members 28*a*-28*d* contact corresponding inclined side surfaces in the cavities 18*a*, 18*b*. The inclined extension members 28*a*-28*d* may include an inclined surface that increases in width from the top of the guiding element 24*a*, 24*b* to the bottom of the guiding element 24*a*, 24*b*. In one aspect, the inclined surface may extend at an angle β relative to the longitudinal axis of the end termination 4. The angle β may be in the range of 0.1 degrees and 10 degrees. In other words, the width of the extension members 28*a*-28*d* at the top of each guiding element 24*a*, 24*b* is smaller than the width of the extension members 28*a*-28*d* at the bottom of each guiding element 24*a*, 24*b*. Each guiding member 24*a*, 24*b* may define a slot 30*a*, 30*b* to receive other components of the end termination 4, as described in greater detail below.

Figure 6:
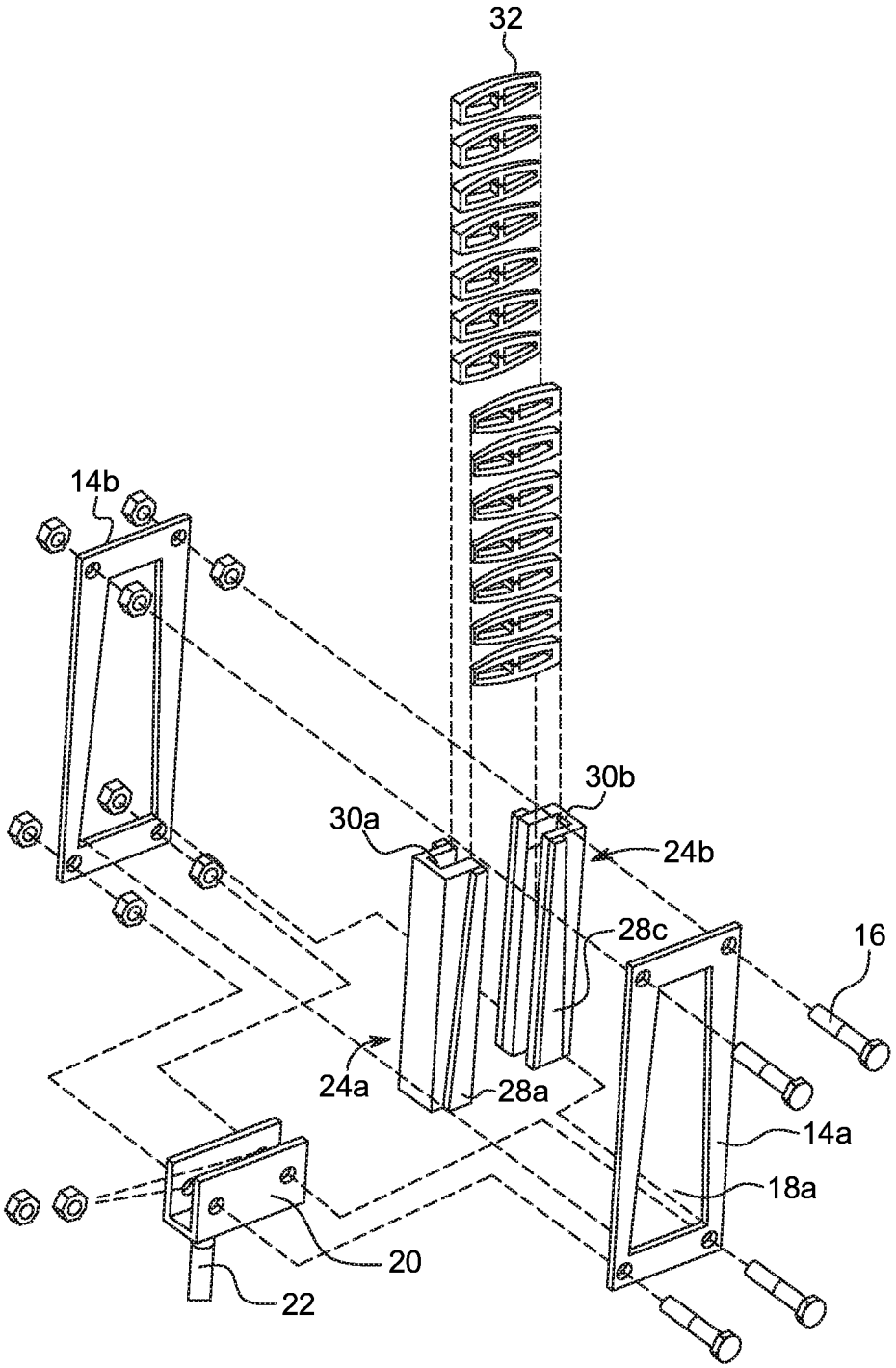
FIG. 6 is an exploded view of the end termination of FIG. 2.
Figure 7:
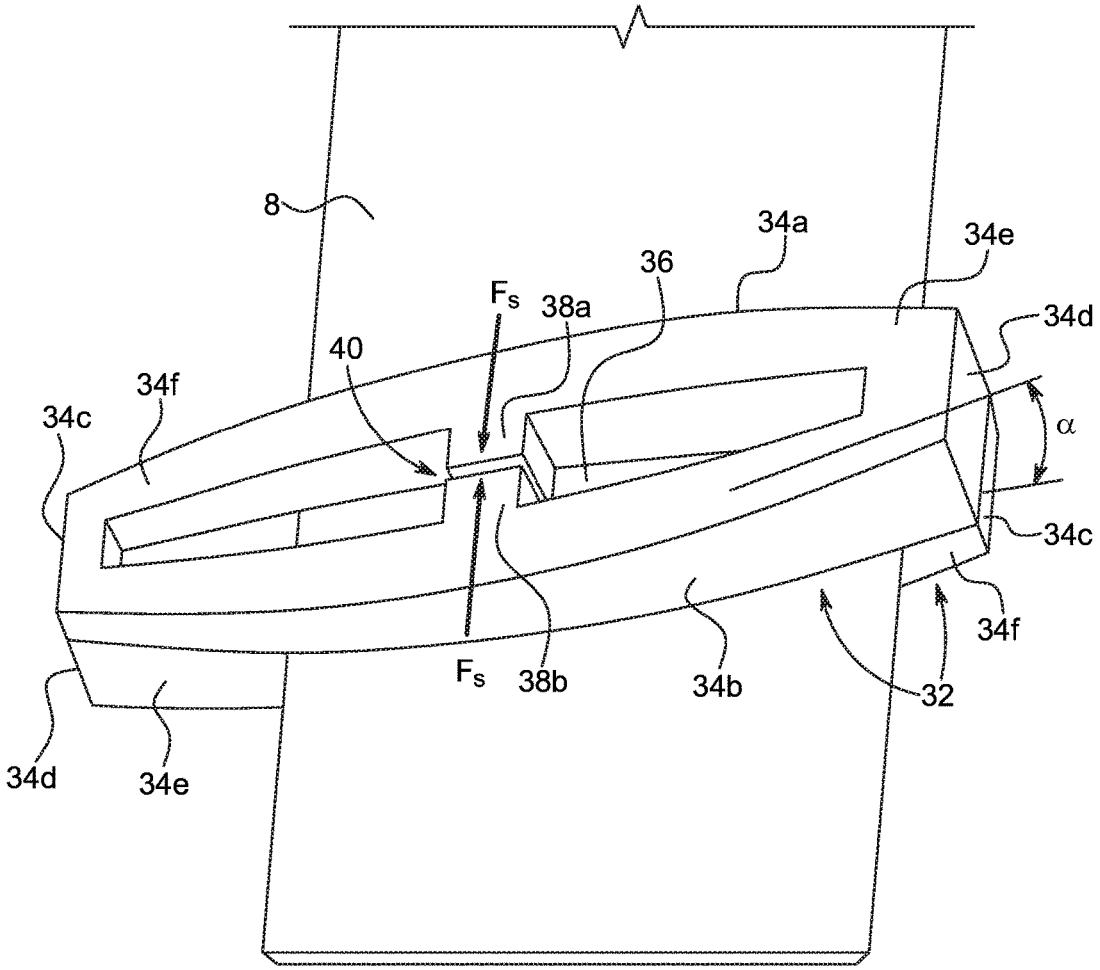
FIG. 7 is a perspective view of a wedge member used in the end termination of FIG. 2.
Figure 8:
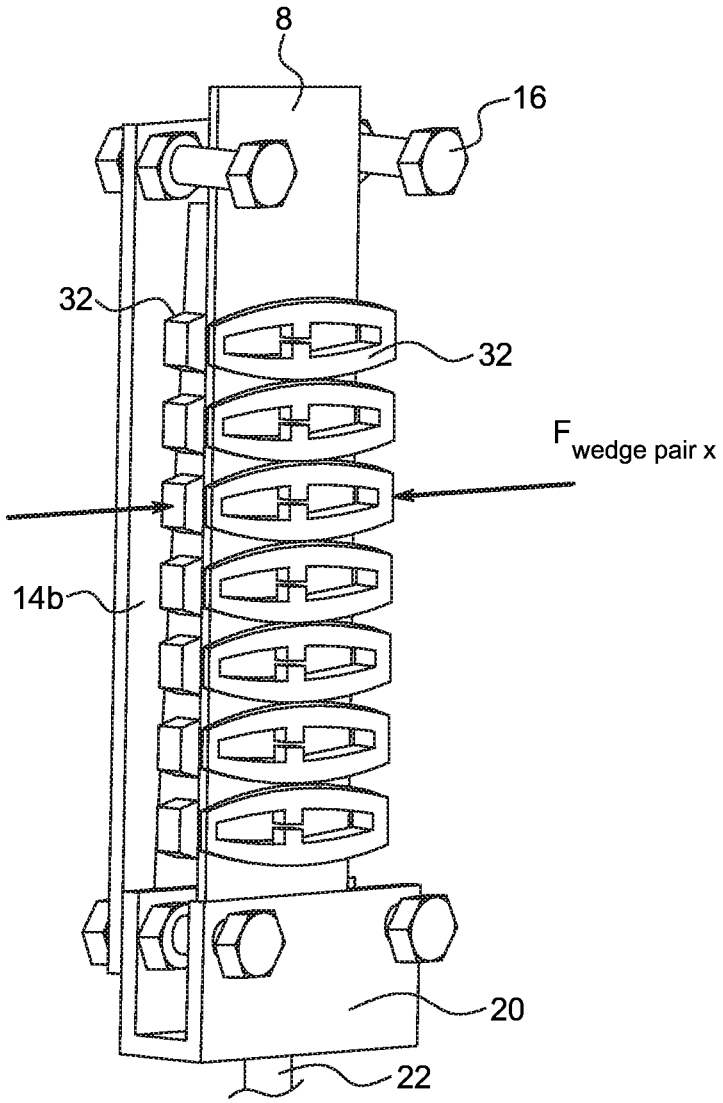
FIG. 8 is a perspective view of the end termination of FIG. 2 with an outer frame member removed.

As shown in FIGS. 2, 6, and 7, at least two wedges 32 may be provided in the end termination 4 to assist in creating a smooth and steady load transfer between the elevator car 6 and the belt 8. In one aspect, a group of at least two wedges 32 may be provided on one side of the belt 8 in the end termination 4, and another group of at least two wedges 32 may be provided on the opposing side of the belt 8 in the end termination 4. As explained in greater detail below, a portion of each wedge 32 may be configured to move inwardly against the belt 8 during operation of the elevator system 2 to create a clamping force on the belt 8. In one aspect, a portion of each wedge 32 may be held within the slots 30*a*, 30*b* defined by the guiding elements 24*a*, 24*b*. In an assembled state of the end termination 4, the belt 8 is held between the wedges 32 in the slots 30*a*, 30*b* defined by the guiding elements 24*a*, 24*b*. In one aspect, seven wedges 32 may be held on one side of the belt 8, and seven wedges 32 may be held on the corresponding opposing side of the belt 8 within the end termination 4. In one aspect, the wedges 32 may be stacked on top of one another in a vertical direction within the end termination 4. In another aspect, the wedges 32 are stacked on top of one another such that the bottom surface of one wedge 32 rests on an upper surface of an adjacent wedge 32. The wedges 32 in the uppermost position of the end termination 4 rest against a nose at an upper end of each slot 30*a*, 30*b*.

Figure 5:
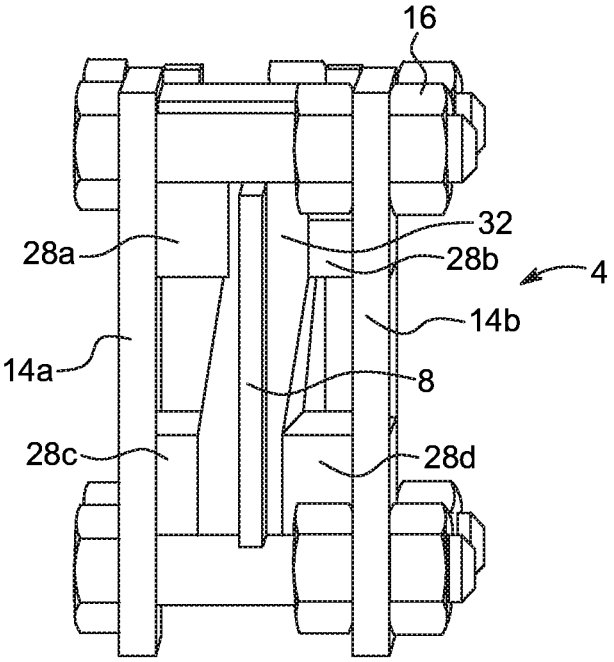
FIG. 5 is a top view of the end termination of FIG. 2.

With reference to FIG. 7, the wedges 32 are described in greater detail. The wedges 32 may be made of a flexible material that permits bending of at least a portion of each wedge 32. In one aspect, the wedges 32 may have a modulus of elasticity of 209,000 N/mm$^2$ and a Poisson's ratio of 0.3 (carbon steel). It is contemplated, however, that the modulus of elasticity may be in the range of 150,000 to 250,000 N/mm$^2$. In one aspect, the wedges 32 may be made of metal, such as spring steel, carbon steel, or other composite materials. Each wedge 32 may include a top surface or member 34*a*, a bottom surface or member 34*b*, and two side surfaces or ends 34*c*, 34*d*. Each wedge 32 may also define a cavity 36. In one aspect, the top surface 34*a* and the bottom surface 34*b* may have a generally arcuate-shape that curves from the center of the wedge 32. In another aspect, the top surface 34*a* and the bottom surface 34*b* may be substantially planar. The side surfaces 34*c*, 34*d* of the wedges 32 may be substantially planar. In one aspect, one side 34*e* of the wedge 32 may have a greater thickness than the opposing side 34*f* of the wedge 32. The thickness of the wedge 32 may increase from one side of the wedge 32 to the opposing side of the wedge 32 at a wedge angle $\alpha$. In one aspect, the wedge angle $\alpha$ may be 0.1 degrees to 15 degrees. It is also contemplated that other various wedge angles may be used for the wedge 32 depending on: the type of belt or rope being terminated, the material or shape of the wedges 32, the arrangements of the components within the elevator system 2, and the travel height of the elevator system 2. The taper direction of each wedge 32 may extend orthogonal or perpendicular to the belt 8 direction. Each wedge 32 may also include at least two protrusions 38*a*, 38*b* that extend from an inner surface of the wedge 32 into the cavity 36 defined by the wedge 32. The protrusions 38*a*, 38*b* extend from a center of the wedge 32. The protrusions 38*a*, 38*b*, however, may not extend so far towards one another so as to contact one another. Instead, an air gap 40 is established between the two protrusions 38*a*, 38*b*. To define the air gap 40, the protrusions 38*a*, 38*b* do not contact one another within the cavity 36. In one aspect, the air gap 40 is provided to allow the wedge 32 to bend inwardly under pressure from a load caused by a pressure force from below the wedge 32 upon the application of a tensile force to the belt 8. In one aspect, the air gap 40 may be in the range of 0.1 mm to 2 mm. The length of the air gap 40 may be adjusted to modify the distance the wedges 32 move inwardly. For example, in the event the air gap 40 is larger, the wedges 32 are permitted to bend inwardly to a greater degree due to the extra length in the air gap 40. In contrast, when the air gap 40 is smaller, the inward bending of the wedges 32 is reduced. By modifying the length of the air gap 40 in the wedges 32, the amount of clamping pressure that is applied to the belt 8 by the pair of wedges 32 provided on either side of the belt 8 may also be adjusted. As shown in FIG. 5, when the end termination 4 is fully assembled, the group of wedges 32 on the first side of the belt 8 may be aligned such that the wider sides of the wedges 32 are positioned on a first edge of the belt 8, and the group of wedges 32 on the second side of the belt 8 may be aligned such that the wider sides of the wedges 32 are positioned on an opposing, second edge of the belt 8. In this arrangement, the wider portions of the wedges 32 in each group of wedges 32 are provided on opposing sides and edges of the belt 8. The wedges 32 may be positioned in the end termination 4 such that a longitudinal axis of each wedge 32 extends substantially perpendicular to a longitudinal axis of the belt 8.

Figure 9:
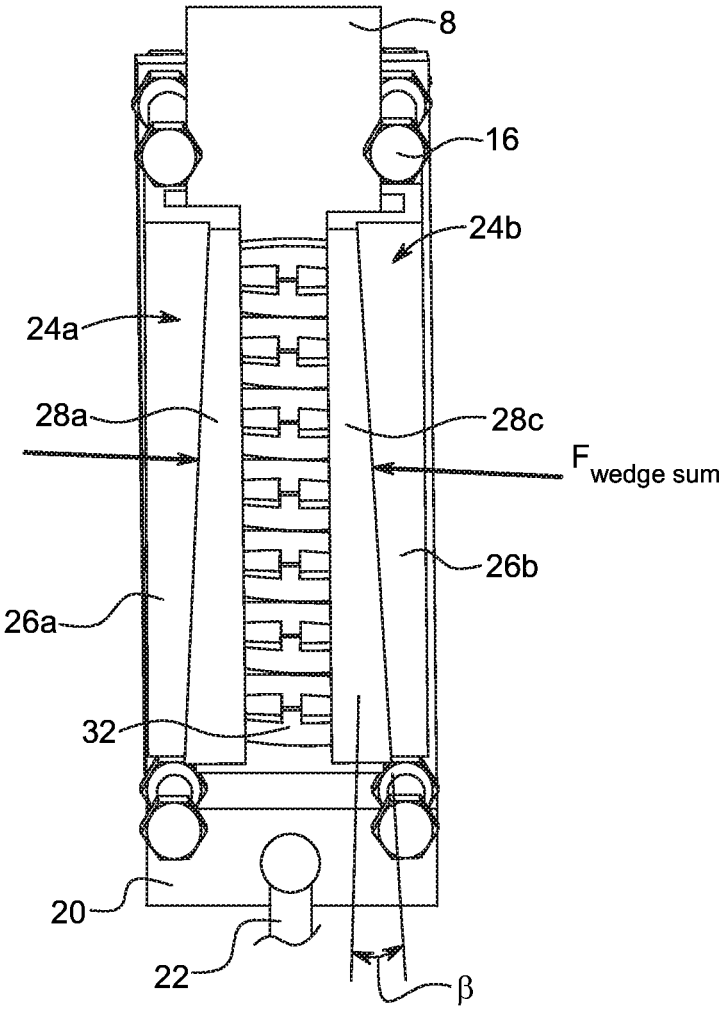
FIG. 9 is a top perspective view of the end termination of FIG. 2.
Figure 10:
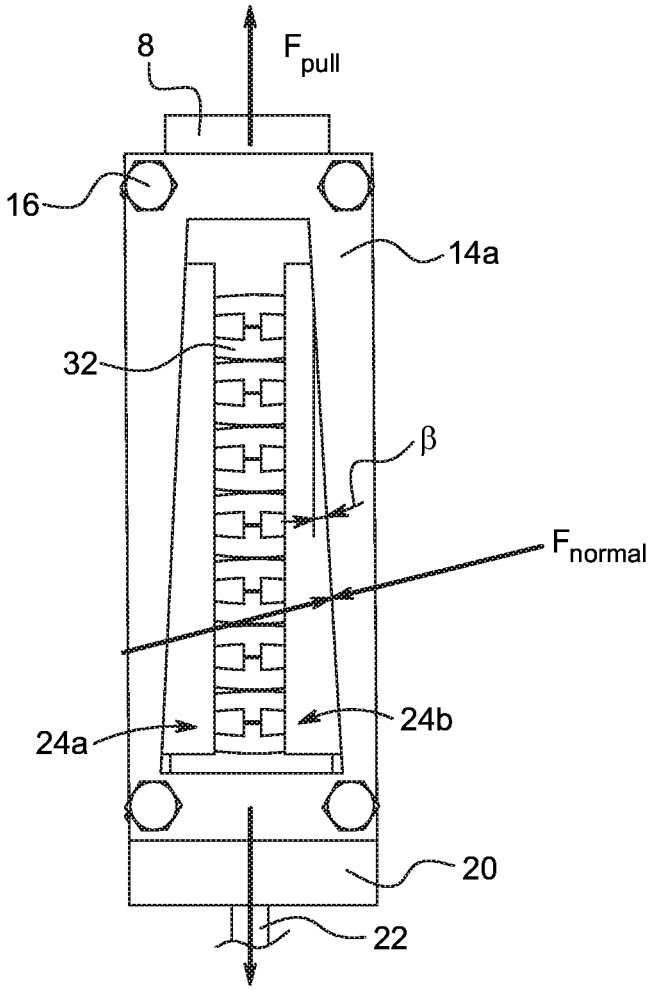
FIG. 10 is a front view of the end termination of FIG. 2 showing forces exerted by the end termination on a belt.
Figure 12A:
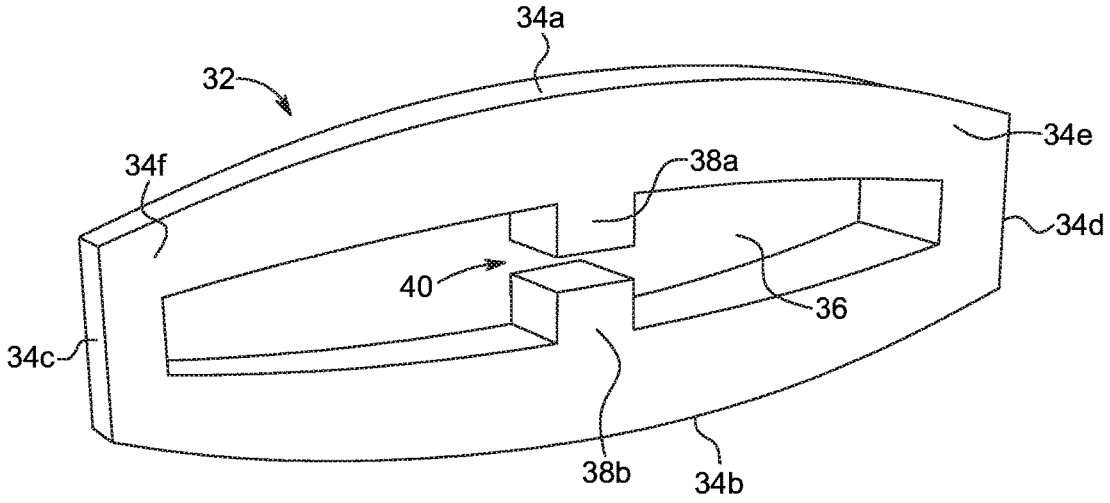
FIG. 12*a* is a front perspective view of a wedge member in an undeformed position according to the present disclosure.
Figure 12B:
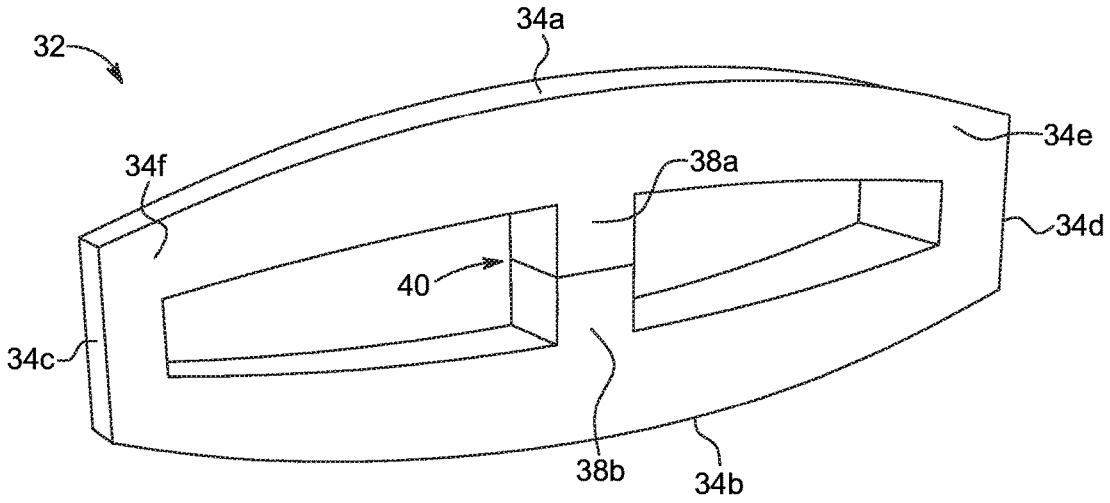
FIG. 12*b* is a front perspective view of the wedge member of FIG. 12*a* in a deformed position.

With reference to FIGS. 2-10, operation and use of the end termination 4 is described. After the end termination 4 has been installed in the elevator system 2, the end termination 4 may be used to create a smooth load transfer between the belt 8 and another component of the elevator system 2. The guiding members 24*a*, 24*b* may be held between the outer wedge plates 14*a*, 14*b*. The wedges 32 may be held within the slots 30*a*, 30*b* defined by the guiding members 24*a*, 24*b* so that the wedges 32 are positioned on both sides of the belt 8 that extends through the end termination 4. As shown in FIG. 10, a belt pull force $F_{pull}$ acts on the belt 8 allowing the belt 8 to slip slightly in relation to some of the wedges 32 within the end termination 4. When the belt pull force $F_{pull}$ reduces, reverse slips occurs and the belt 8 begins to return to its original orientation in relation to some of the wedges 32 within the end termination 4. As also shown in FIG. 10, upon application of the belt pull force $F_{pull}$, the guiding elements 24*a*, 24*b* begin to move relative to the outer wedge plates 14*a*, 14*b* so that an outer wedge normal force $F_{normal}$ is applied to the guiding elements 24*a*, 24*b*. The inclined extension members 28*a*-28*d* of the guiding elements 24*a*, 24*b* slide along the inclined inner edges of the cavities 18*a*, 18*b* defined in the outer wedge plates 14*a*, 14*b*. With reference to FIG. 9, as the inclined extension members 28*a*-28*d* slide along the inclined inner edges of the cavities 18*a*, 18*b*, a wedge activation force $F_{sum}$ is applied to the wedges 32 in the end termination 4. The wedge activation force $F_{sum}$ is applied to the sides 34*c*, 34*d* of the wedges 32 on both sides of the belt 8 to deform the wedges 32 inwardly towards one another to apply the clamping force to the belt 8. In one aspect, the wedges 32 are elastically deformed towards one another. The inward wedge activation force $F_{sum}$ created by the extension members 28*a*-28*d* on the wedges 32 creates a wedge activation force $F_{wedge\ pair\ x}$ for each pair of opposing wedges in the end termination 4. The wedge activation force $F_{wedge\ pair\ x}$ thereby creates a side load $F_s$ on the wedges 32 (shown in FIG. 7) to apply a belt clamp force. As shown in FIG. 12*b*, under the influence of the belt pulling force $F_{pull}$ and controlled slippage; the air gaps 40 in the wedges 32 become smaller. The side load $F_s$ moves at least a portion of each wedge 32 inwardly to create a clamping force on the belt 8 with the opposing wedge 32.

Figure 11:
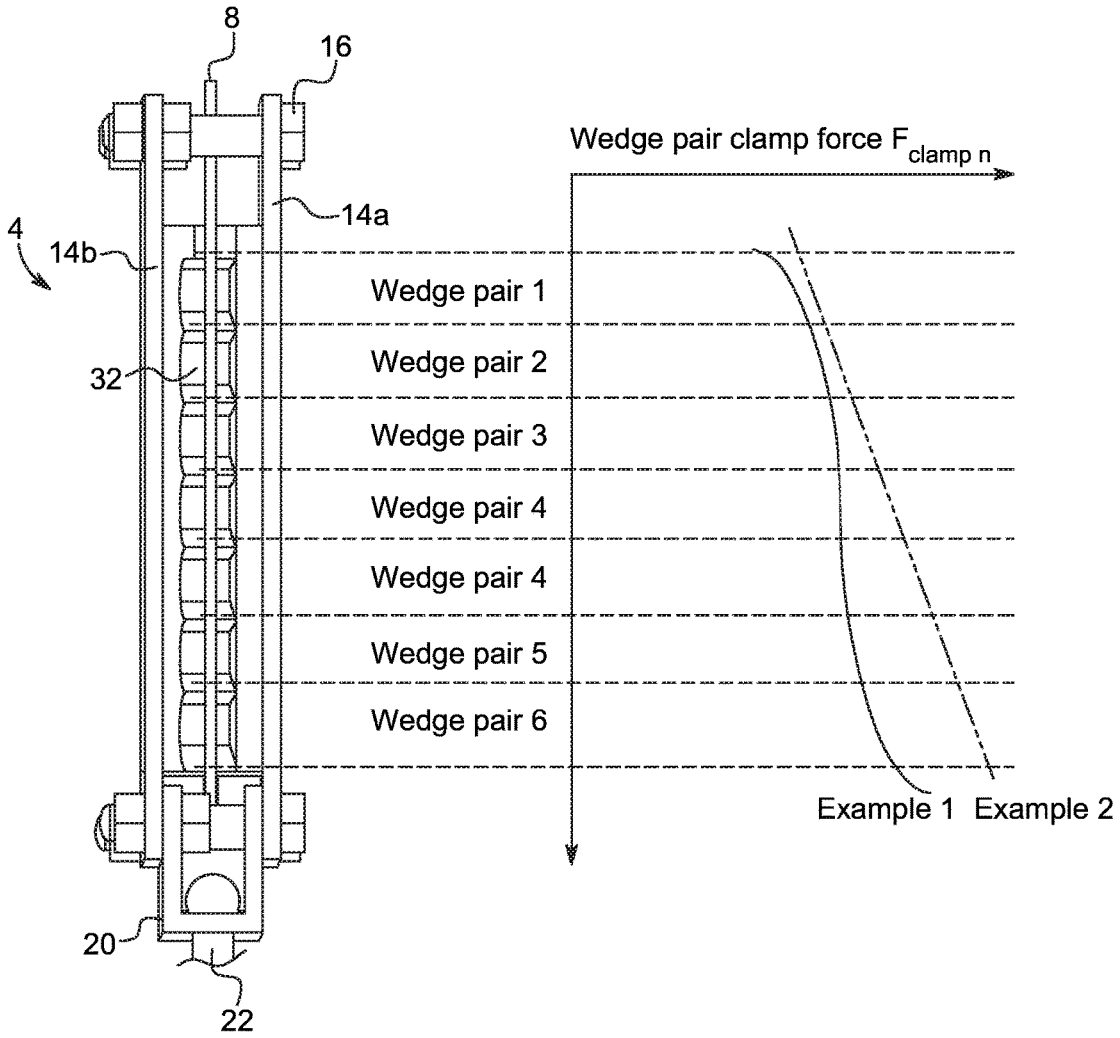
FIG. 11 is a schematic view showing the load transfer curve corresponding to the wedge pairs used in the end termination of FIG. 2.

With reference to FIG. 11, by using the multi-wedge arrangement for the end termination 4 it is possible that each wedge 32 may provide a different amount of clamping force that allows for the programming of the load transfer function between the end termination 4 and the belt 8. Each pair of wedges 32 in the end termination 4 may be designed with a specific dimensions to achieve a desired load transfer curve between the end termination 4 and the belt 8, as shown by Example 1 and Example 2 in FIG. 11. Another method to program a load transfer curve is a modified slot surface relative to the wedge 32. The modified slot, for example, allows different side movements for each wedge pair to reach a desired clamp force distribution. The elasticity of the wedges 32 allow for a better load transfer than traditional wedge end terminations and provides controlled and reversible slippage in the event of impact loads in the elevator system 2, for example, an impact after a counterweight jumps within the elevator system 2. The load transfer function may be programmed or designed with a height profile relative to the impact surface of the belt 8 to achieve a desired load transfer function for each particular elevator system 2. As shown with the height profile in FIG. 11, the wedge pairs may be designed to achieve a desired load transfer function. As shown with Example 1, a more gradual and varying load transfer may be achieved by designing the first wedge pair to provide a lower wedge pair clamp force $F_{clamp\ n}$ and a sixth wedge pair to provide a higher wedge pair clamp force $F_{clamp\ n}$. As shown with Example 2, a smoother and more linear load transfer may be achieved by adjusting the wedge pair clamp force $F_{clamp\ n}$ between each wedge pair by an equal amount. Using different materials and/or different shapes and configurations for the wedges 32, a plurality of different load transfer functions can be achieved with the multi-wedge end termination 4. When using a plurality of wedge pairs, the overall clamp force for an end termination 4 with v number of wedge pairs is $F_{clamp,\ sum}=\Sigma^{v}_{n=1}F_{clamp,\ n}$. The wedge pair at least in the bottom position of the end termination 4 allows no slippage, which allows the overall belt 8 movement in the end termination 4 to be reversible.

While several aspects of the end termination 4 are shown in the accompanying figures and described in detail hereinabove, other aspects will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. An end termination for an elevator system, comprising:

at least two opposing outer plates connected to one another;

at least two opposing guiding elements held between the outer plates; and at least two opposing wedges extending between the guiding elements and configured to clamp an elevator belt therebetween, wherein, upon application of a belt pull force to the elevator belt, the wedges are deformed towards one another to increase a clamping force on the elevator belt, and wherein each wedge includes a thickness on a first side thereof that is greater than a thickness on a second side thereof and are positioned on opposing sides of the elevator belt such that the thicker first side of a first wedge is positioned opposite the thinner second side of a second wedge when the elevator belt is disposed between the first wedge and the second wedge.

2. The end termination as claimed in claim 1, wherein each outer plate defines a cavity and includes two opposing inner side edges that are inclined relative to a longitudinal axis of the end termination.

3. The end termination as claimed in claim 2, wherein the guiding elements each include at least two inclined extension members each in contact with one of the inclined inner side edges of one of the outer plates.

4. The end termination as claimed in claim 2, wherein, upon application of the belt pull force to the elevator belt, the guiding elements are moved axially in the cavities of the outer plates.

5. The end termination as claimed in claim 4, wherein the movement of the guiding elements imparts a force on opposing ends of the wedges to deform the wedges toward one another adjusting a distribution of the clamping force on the elevator belt based on a belt pull force, allowing reversible slippage of the elevator belt within the end termination.

6. The end termination as claimed in claim 1, wherein each wedge includes a top member and a bottom member opposing the top member, the top member and the bottom member defining an air gap therebetween.

7. The end termination as claimed in claim 1, further comprising a first plurality of wedges and a second plurality of wedges, and wherein the first plurality of wedges and the second plurality of wedges are positioned on opposing sides of the elevator belt and distributed longitudinally along the elevator belt.

8. The end termination as claimed in claim 1, wherein each guiding element defines a slot to receive one end of each wedge.

9. An elevator system, comprising:

at least one elevator car hoisted and lowered by an elevator belt; and at least one end termination operatively connected to the elevator belt and the elevator car, the end termination comprising:

at least two opposing outer plates connected to one another;

at least two opposing guiding elements held between the outer plates; and at least two opposing wedges extending between the guiding elements and configured to clamp the elevator belt therebetween, wherein, upon application of a belt pulling force to the elevator belt, the wedges are deformed towards one another to increase a clamping force on the elevator belt, and wherein each wedge includes a thickness on a first side thereof that is greater than a thickness on a second side thereof and are positioned on opposing sides of the elevator belt such that the thicker first side of a first wedge is positioned opposite the thinner second side of a second wedge when the elevator belt is disposed between the first wedge and the second wedge.

10. The elevator system as claimed in claim 9, wherein each outer plate defines a cavity and includes two opposing inclined inner edges.

11. The elevator system as claimed in claim 10, wherein the guiding elements each include at least two inclined extension members each in contact with one of the inclined inner edges of one of the outer plates.

12. The elevator system as claimed in claim 10, wherein, upon application of the belt pull force to the elevator belt, the guiding elements are moved axially in the cavities of the outer plates.

13. The elevator system as claimed in claim 12, wherein the movement of the guiding elements imparts a force on opposing ends of the wedges to deform the wedges toward one another adjusting a distribution of the clamping force on the elevator belt based on a belt pull force, allowing reversible slippage of the elevator belt within the end termination.

14. The elevator system as claimed in claim 9, wherein each wedge includes a top member and a bottom member opposing the top member, the top member and the bottom member defining an air gap therebetween.

15. The elevator system as claimed in claim 9, further comprising a first plurality of wedges and a second plurality of wedges, and wherein the first plurality of wedges and the second plurality of wedges are positioned on opposing sides of the elevator belt and distributed longitudinally along the elevator belt.

16. The end termination as claimed in claim 9, wherein each guiding element defines a slot to receive one end of each wedge.

17. The end termination as claimed in claim 1, wherein the at least two opposing wedges comprises a first plurality of wedges and an opposing second plurality of wedges extending between the guiding elements and configured to clamp the elevator belt therebetween, wherein the first plurality of wedges and the opposing second plurality of wedges are arranged in opposing pairs distributed longitudinally along the elevator belt, and wherein each of the opposing pairs is configured to provide a different amount of clamping force along the portion of the elevator belt disposed in the end termination.

18. The elevator system as claimed in claim 9, wherein the at least two opposing wedges comprises a first plurality of wedges and an opposing second plurality of wedges extending between the guiding elements and configured to clamp the elevator belt therebetween, wherein the first plurality of wedges and the opposing second plurality of wedges are arranged in opposing pairs distributed longitudinally along the elevator belt, and wherein each of the opposing pairs is configured to provide a different amount of clamping force along the portion of the elevator belt disposed in the end termination.

* * * * *